US008857448B2

(12) United States Patent
Robert et al.

(10) Patent No.: US 8,857,448 B2
(45) **Date of Patent: *Oct. 14, 2014**

(54) TUNNEL WASHER SYSTEM WITH IMPROVED CLEANING EFFICIENCY

(75) Inventors: Maxime Robert, Quebec (CA); Eugene Cantin, Chrysostome (CA); Daniel Giguère, Quebec (CA); Louis Martineau, Quebec (CA); Nathalie Thibault, Quebec (CA)

(73) Assignee: STERIS Inc., Temecula, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/577,373

(22) Filed: Oct. 12, 2009

(65) Prior Publication Data

US 2010/0024849 A1 Feb. 4, 2010

Related U.S. Application Data

(62) Division of application No. 11/227,938, filed on Sep. 15, 2005, now Pat. No. 7,621,285.

(51) Int. Cl.

| | |
|---|---|
| ***B08B 3/02*** | (2006.01) |
| ***B08B 9/08*** | (2006.01) |
| ***F26B 15/18*** | (2006.01) |
| ***F26B 21/00*** | (2006.01) |
| ***F26B 5/14*** | (2006.01) |

(52) U.S. Cl.

CPC ..... *B08B 9/0861* (2013.01); *F26B 15/18* (2013.01); *F26B 21/004* (2013.01); *B08B 3/022* (2013.01); *F26B 5/14* (2013.01)

USPC ..... 134/61

(58) Field of Classification Search

USPC ..... 134/61

See application file for complete search history.

(56) References Cited

U.S. PATENT DOCUMENTS

| | | | | |
|---|---|---|---|---|
| 2,440,157 | A | 4/1948 | Rousseau | 34/229 |
| 2,766,764 | A | 10/1956 | Bennett | 134/72 |

(Continued)

FOREIGN PATENT DOCUMENTS

| | | | | |
|---|---|---|---|---|
| EP | 0838190 | A2 * | 9/1997 | A47L 15/24 |
| EP | 0838191 | A2 * | 9/1997 | A47L 15/24 |

(Continued)

OTHER PUBLICATIONS

U.S. Appl. No. 12/577,401, filed Oct. 12, 2009, Robert et al., entitled: Tunnel Washer System with Improved Cleaning Efficiency.

(Continued)

*Primary Examiner* — Michael Barr
*Assistant Examiner* — Jason Riggleman
(74) *Attorney, Agent, or Firm* — Kusner & Jaffe; Michael A. Centanni

(57) ABSTRACT

A tunnel washer that includes fluid exhaust paths that are optimized to minimize fluid transfer between chambers of the washer and minimize heat loss from each chamber of the washer. The fluid exhaust paths also facilitate uniform vapor evacuation from each chamber of the washer. The tunnel washer also includes spaced-apart double wall curtains for isolating chambers of the tunnel washer to prevent fluid and heat transfer therebetween, and to the exterior of the tunnel washer. The double wall curtains include surfaces that inhibit the curtains from sticking together during operation of the tunnel washer. The tunnel washer also includes an air manifold that provides uniform drying efficiency for articles of varying dimensions.

6 Claims, 6 Drawing Sheets

(56) References Cited

U.S. PATENT DOCUMENTS

| | | | | |
|---|---|---|---|---|
| 3,166,082 | A | 1/1965 | Arnold et al. | 134/78 |
| 3,175,565 | A | 3/1965 | Dawson | 134/70 |
| 3,598,131 | A | 8/1971 | Weibe, Jr. | 134/107 |
| 3,877,107 | A | 4/1975 | Cirino | 15/302 |
| 4,396,050 | A | 8/1983 | Vandagriff | 144/380 |
| 4,872,238 | A | 10/1989 | Crotts et al. | 15/302 |
| 4,985,956 | A * | 1/1991 | van der Schoot | 15/3.13 |
| 5,062,217 | A | 11/1991 | Tolson | 34/443 |
| 5,372,153 | A | 12/1994 | Dobson | 134/107 |
| 5,460,845 | A | 10/1995 | Dalmasso et al. | 426/320 |
| 5,487,283 | A | 1/1996 | Sheppard | 68/27 |
| 5,535,667 | A | 7/1996 | Dalmasso et al. | 99/472 |
| 5,622,196 | A | 4/1997 | Luongo | 134/72 |
| 5,771,840 | A | 6/1998 | Pelletier | 119/452 |
| 5,964,955 | A | 10/1999 | Rochette et al. | 134/10 |
| 6,088,864 | A | 7/2000 | Smith, II | 15/53.1 |
| 6,090,218 | A | 7/2000 | Brackmann et al. | 134/15 |
| 6,394,033 | B1 | 5/2002 | Trogstam et al. | 119/458 |
| 6,634,507 | B1 | 10/2003 | Host-Madsen et al. | 209/702 |
| 6,916,445 | B2 | 7/2005 | Centanni et al. | 422/22 |
| 6,990,751 | B2 | 1/2006 | Riley et al. | 34/506 |
| 2002/0159915 | A1 | 10/2002 | Zelina et al. | 422/3 |
| 2003/0110815 | A1 | 6/2003 | Poy | 68/27 |
| 2003/0136433 | A1 * | 7/2003 | Becknell | 134/124 |
| 2003/0213502 | A1 | 11/2003 | Eriksson | 134/10 |
| 2004/0016444 | A1 | 1/2004 | Mitchell et al. | 134/6 |

FOREIGN PATENT DOCUMENTS

| | | | | |
|---|---|---|---|---|
| JP | 50-145614 | | 12/1975 | B08B 3/02 |
| JP | 61-103062 | | 7/1986 | A47L 15/24 |
| JP | 62-61671 | | 4/1987 | A47L 15/24 |
| JP | 3004334 | | 11/1994 | B08B 3/12 |
| JP | 07-116614 | | 5/1995 | B08B 3/02 |
| JP | 08-209371 | * | 8/1996 | B08B 3/08 |
| JP | 2000-084515 | | 3/2000 | B08B 15/04 |
| JP | 2005-008136 | | 1/2005 | B60S 1/62 |
| WO | WO 00/18522 | | 4/2000 | B08B 3/02 |
| WO | WO2006/007233 | A1 * | 5/2005 | A47L 15/24 |

OTHER PUBLICATIONS

Office Action (dated Oct. 6, 2011) issued in connection with corresponding Japanese Patent Application No. 2010-100444, with English translation.

Office Action (dated Aug. 6, 2013) issued in connection with corresponding Japanese Patent Application No. 2012-089779, with English translation.

* cited by examiner

TUNNEL WASHER SYSTEM WITH IMPROVED CLEANING EFFICIENCY

RELATED APPLICATIONS

This application is a divisional of U.S. application Ser. No. 11/227,938 (filed Sep. 15, 2005) now U.S. Pat. No. 7,621,285 which is fully incorporated herein by reference.

FIELD OF THE INVENTION

The present invention relates generally to washing systems, and more particularly to a tunnel washer commonly used for cleaning articles used in the care of laboratory animals.

BACKGROUND OF THE INVENTION

Tunnel washers are widely used for cleaning articles used in the care of laboratory animals, such as animal cages (e.g., wire cages and plastic boxes), racks, debris pans, watering devices, bottles, and feeder bowls. Tunnel washers are typically divided into a plurality of processing chambers, wherein pre-washing, washing, rinsing and drying operations are respectively performed. During the pre-washing, washing and rinsing operations various fluids, including, but not limited to, water and water vapor, are introduced and removed from the respective chambers. During drying operations, heated air is circulated through a drying chamber.

The present invention provides a tunnel washer that improves the efficiency of the pre-washing, washing, rinsing and drying operations.

SUMMARY OF THE INVENTION

In accordance with the present invention, there is provided a tunnel washer for washing an article, comprising: a plurality of adjacent processing chambers for processing the article; and at least one set of curtains for inhibiting fluid transfer between adjacent processing chambers, each set of curtains comprised of a first curtain and a second curtain, said first curtain mounted at a first location and said second curtain mounted generally parallel to said first curtain at a second location spaced from said first location.

In accordance with another aspect of the present invention, there is provided a tunnel washer for washing an article, comprising: a pre-washing chamber, a washing chamber, and a rinsing chamber; an exhaust duct in fluid communication with a ventilation system, the pre-washing chamber and the rinsing chamber; and a blower for drawing fluid into the exhaust duct from the pre-washing chamber and the rinsing chamber for exhaust through the ventilation system, wherein said washing chamber and said rinsing chamber are not in fluid communication with said exhaust duct.

In accordance with still another aspect of the present invention, there is provided a tunnel washer for washing an article, comprising: a pre-washing chamber, a washing chamber, and a rinsing chamber; an exhaust duct in fluid communication with a ventilation system, said exhaust duct having only two inlets for receiving fluid, the first inlet disposed at an entrance end to the pre-washing chamber and the second inlet disposed at an exit end of the rinsing chamber; and a blower for drawing fluid into the exhaust duct from the pre-washing chamber and the rinsing chamber for exhaust through the ventilation system.

In accordance with still another aspect of the present invention, there is provided an apparatus for drying articles in a drying chamber of a tunnel washer, the apparatus comprising: an air tube in fluid communication with a source of air, said air tube including a plurality of nozzles for providing streams of pressurized air; a pair of arms, each arm having a first end pivotally mounted within said drying chamber and a second end for supporting said air tube; a pair of bias members for respectively suspending said air tube at a first location within the drying chamber, wherein the height of the air tube within the drying chamber is adjustable to generally maintain a distance D between the air tube and an upper surface of an article being dried in said drying chamber.

In accordance with still another aspect of the present invention, there is provided an apparatus for drying articles in a drying chamber of a tunnel washer, the apparatus comprising: an air tube in fluid communication with a source of air, said air tube including a plurality of nozzles for providing streams of pressurized air; means for suspending the air tube in the drying chamber above articles being dried therein, wherein said air tube is movable within said drying chamber; wherein the height of the air tube within the drying chamber is adjustable to generally maintain a distance D between the air tube and an upper surface of the article being dried in said drying chamber.

In accordance with yet another aspect of the present invention, there is provided a tunnel washer for washing an article, comprising: a pre-washing chamber for pre-washing the article; a washing chamber for washing the article after pre-washing; a rinsing chamber for rinsing the article after washing, said rinsing chamber including a conduit for recycling the water used for rinsing the article to the pre-washing chamber and the washing chamber.

An advantage of the present invention is the provision of a tunnel washer having fluid exhaust paths that are optimized to minimize fluid transfer between chambers of the washer.

Another advantage of the present invention is the provision of a tunnel washer having fluid exhaust paths that are optimized to minimize heat loss from chambers of the washer.

Another advantage of the present invention is the provision of a tunnel washer having fluid exhaust paths that facilitate uniform vapor evacuation from each chamber of the washer.

Another advantage of the present invention is the provision of a tunnel washer having spaced-apart double wall curtains for isolating chambers of the tunnel washer to prevent fluid and heat transfer therebetween.

A still further advantage of the present invention is the provision of a tunnel washer having double wall curtains with surfaces that inhibit the curtains from sticking together during operation of the tunnel washer.

Still another advantage of the present invention is the provision of a tunnel washer having uniform drying efficiency for articles of varying dimensions.

Still another advantage of the present invention is the provision of a tunnel washer having improved drying efficacy.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof and wherein.

DETAILED DESCRIPTION OF A PREFERRED EMBODIMENT

Figure 1:
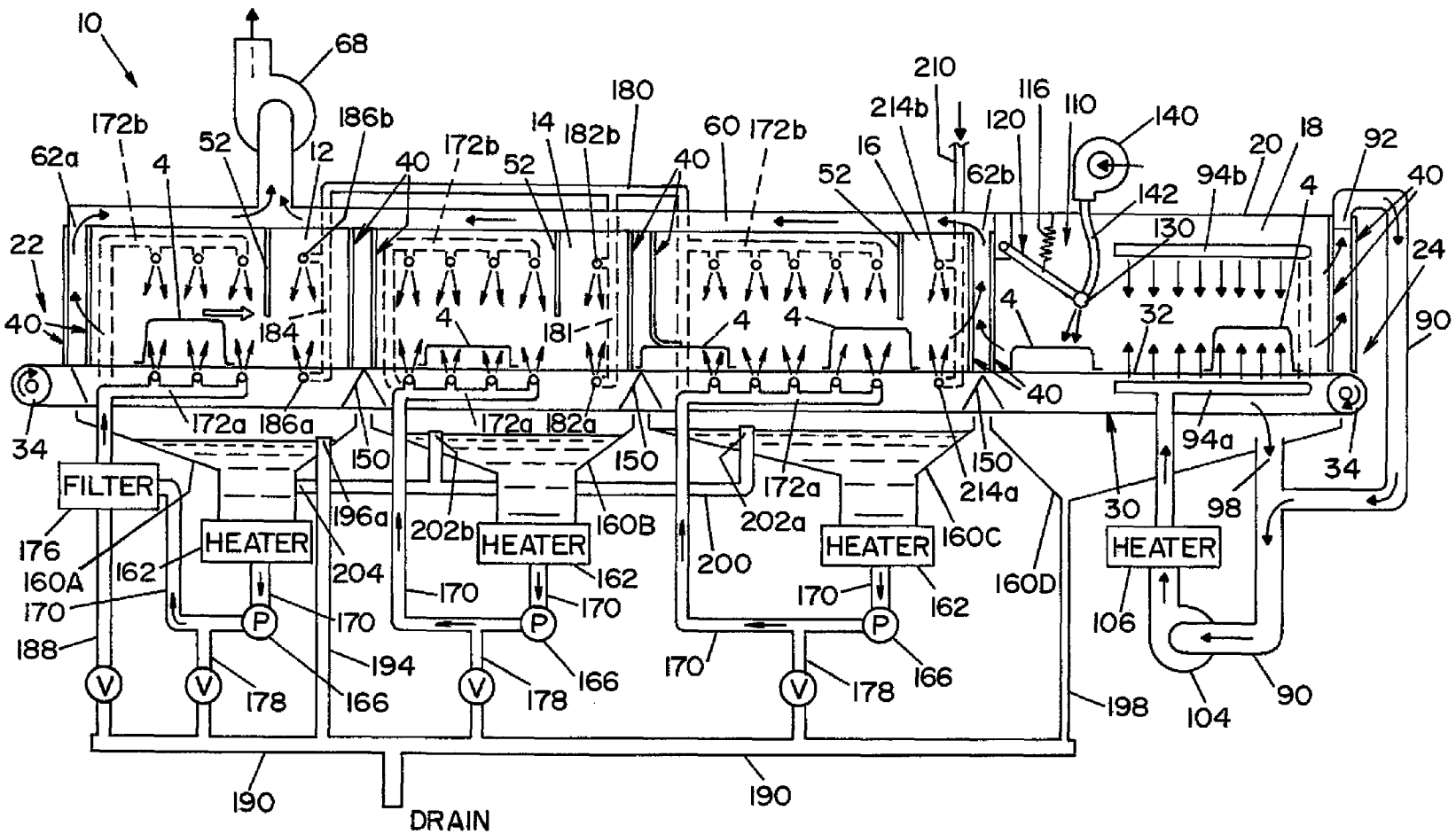
FIG. 1 is a schematic, side elevational view of a tunnel washer, according to a preferred embodiment of the present invention, wherein the pre-washing, washing, rinsing and drying chambers of the tunnel washer are shown.

Referring now to the drawings wherein the showings are for the purposes of illustrating a preferred embodiment of the invention only and not for the purposes of limiting same, FIG. 1 shows a schematic, side elevational view of a tunnel washer 10, according to a preferred embodiment of the present invention. A housing 20 encloses a conveyer 30. Housing 20 defines an inner chamber that is divided into four (4) processing chambers, namely, a pre-washing chamber 12, a washing chamber 14, a rinsing chamber 16 and a drying chamber 18. Components and operation of each chamber 12, 14, 16 and 18 will be described in detail below.

Conveyer 30 is a conventional conveyer device generally comprised of a conveyer belt 32 and a pair of rollers 34 that are driven by a motor (not shown). Conveyer belt 32 extends through chambers 12, 14, 16 and 18, as shown in FIG. 1.

Articles 4 to be processed by tunnel washer 10 are loaded onto conveyer belt 32 at loading end 22 of tunnel washer 10. After processing by tunnel washer 10, articles 4 are removed from conveyer belt 32 at unloading end 24 of washer 10.

Figure 2:
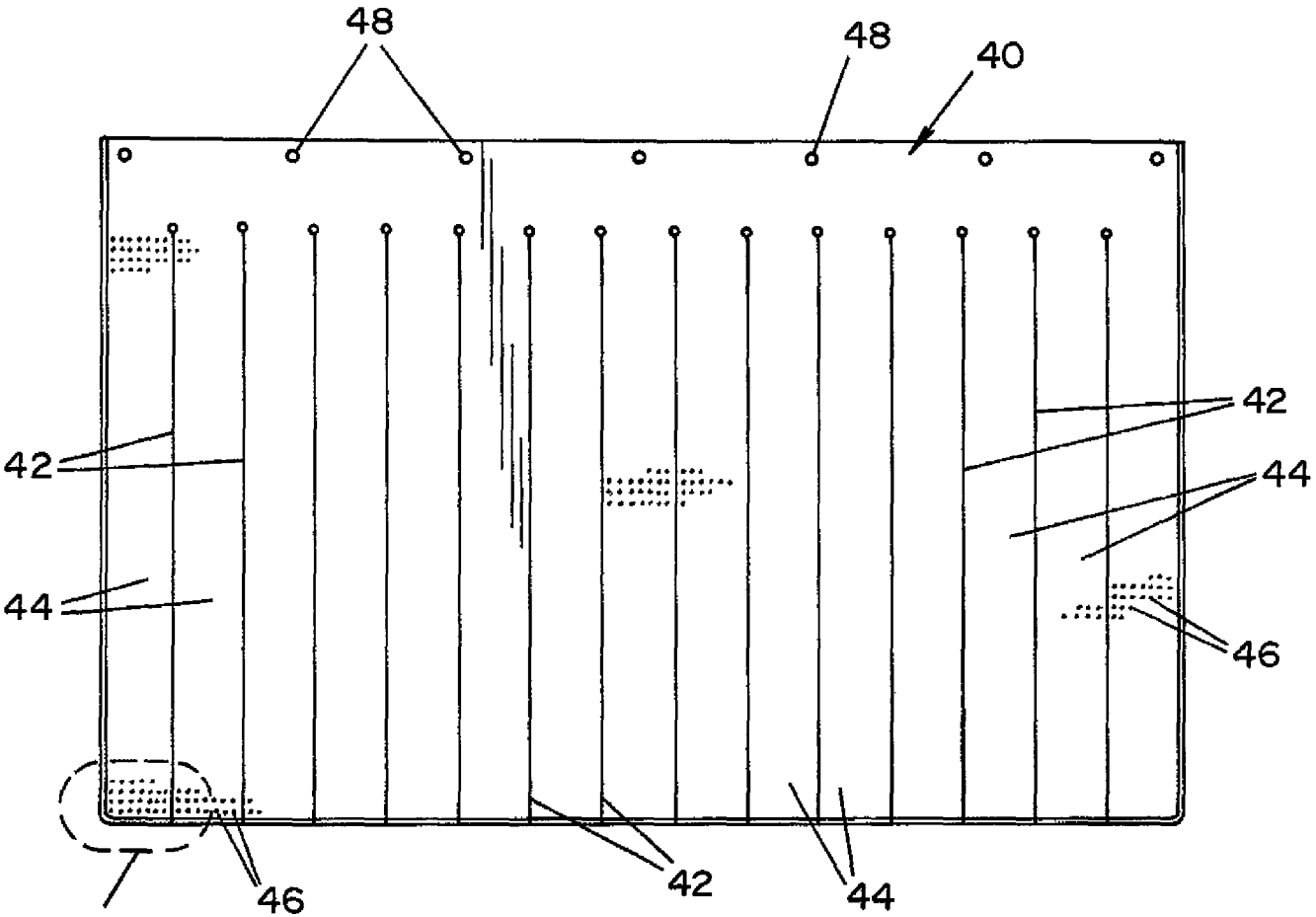
FIG. 2 is a front plan view of a dividing curtain according to a preferred embodiment of the present invention.
Figure 3:
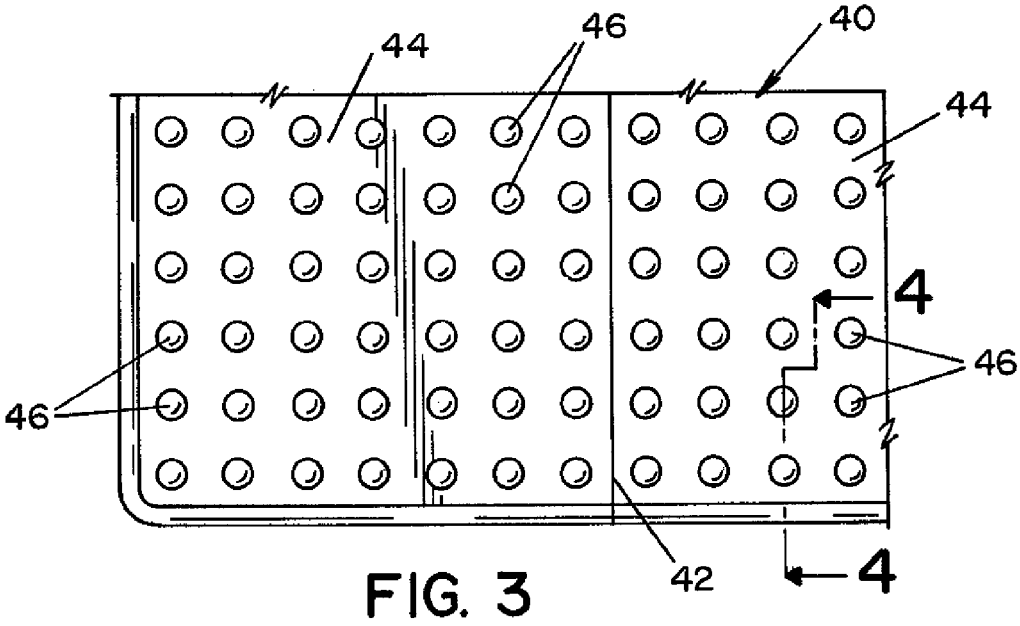
FIG. 3 is an enlarged view of a portion of the dividing curtain shown in FIG. 2.
Figure 4:
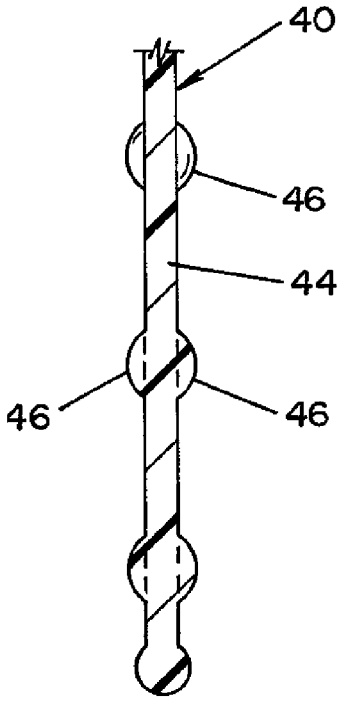
FIG. 4 is a cross-sectional view of the dividing curtain, taken along lines 4-4 of FIG. 3.

A plurality of vertical, spaced-apart dividing curtains 40 are located at opposite ends of each chamber 12, 14, 16 and 18, thus defining the length of each chamber, and isolating each chamber by providing a fluid barrier therebetween. FIG. 2 shows a front plan view of a dividing curtain 40. Curtain 40 is a generally planar flexible sheet, preferably made of a flexible polymer, and more particularly an elastomer. Curtain 40 may also be formed of rubber or other suitable material. A plurality of holes 48 are formed at the top end of curtain 40. Holes 48 are dimensioned to receive a fastening means for suspending curtain 40 at the top of chambers 12, 14, 16 and 18, as will be further described below. In the illustrated embodiment, dividing curtains 40 are dimensioned to extend the height of each chamber 12, 14, 16 and 18. A plurality of slits 42 are formed in each curtain 40 to form a plurality of flaps 44. Each flap 44 is independently moveable. A plurality of spaced protuberances 46 are formed on the front and rear surfaces of flaps 44, as best seen in FIGS. 3 and 4. In the illustrated embodiment, protuberances 46 are generally semi-spherical bumps.

At least one inner curtain 52 is located within each chamber 12, 14 and 16. Inner curtains 52 also function as fluid barriers. Inner curtain 52 is substantially the same as dividing curtain 40, but is shorter in length according to the illustrated embodiment. Furthermore, inner curtain 52 may be flat and not include protuberances on the front and rear surfaces thereof. In this regard, the front and rear surfaces of any flaps of inner curtain 52 may be substantially smooth.

An exhaust duct 60 extends along the upper region of chambers 12, 14, and 16, and is in fluid communication with pre-washing chamber 12, rinsing chamber 16 and a ventilation system (not shown). In this regard, exhaust duct 60 has a first inlet **62*a* that is disposed at the entrance end of pre-washing chamber 12, and a second inlet 62*b* that is disposed at the exit end of rinsing chamber 16. An exhaust blower 68 draws fluid into exhaust duct 60**, where it is exhausted to a ventilation system (not shown).

A recirculation duct 90 recirculates fluid (e.g., hot air) inside drying chamber 18. Recirculation duct 90 includes an inlet 92, a lower outlet **94*a*, and an upper outlet 94*b*. Inlet 92 is in fluid communication with an upper region of drying chamber 18 proximate to unloading end 24. Lower outlet 94*a* is located in a lower region of drying chamber 18, while upper outlet 94*b* is located in an upper region of drying chamber 18. A blower 104 and heater 106 are located in recirculation duct 90. Blower 104 draws air at unloading end 24 into recirculation duct 90, and recirculates this air back into drying chamber 18 through lower outlet 94*a* and upper outlet 94*b*. The air is heated by heater 106 before it is returned to drying chamber 18. A return conduit 98 is in fluid communication with a sump 160D (described below) and recirculation duct 90**.

Mounting members 66 (best seen in FIGS. 5, 7, and 8) extend downward from exhaust duct 60 and recirculation duct 90. Dividing curtains 40 are suspended from mounting members 66. In the illustrated embodiment, dividing curtains 40 are attached to mounting brackets 66 by locating a fastening means through holes 48 of dividing curtains 40. Inner dividing curtains 52 are preferably suspended in the same manner as dividing curtains 40.

Figure 5:
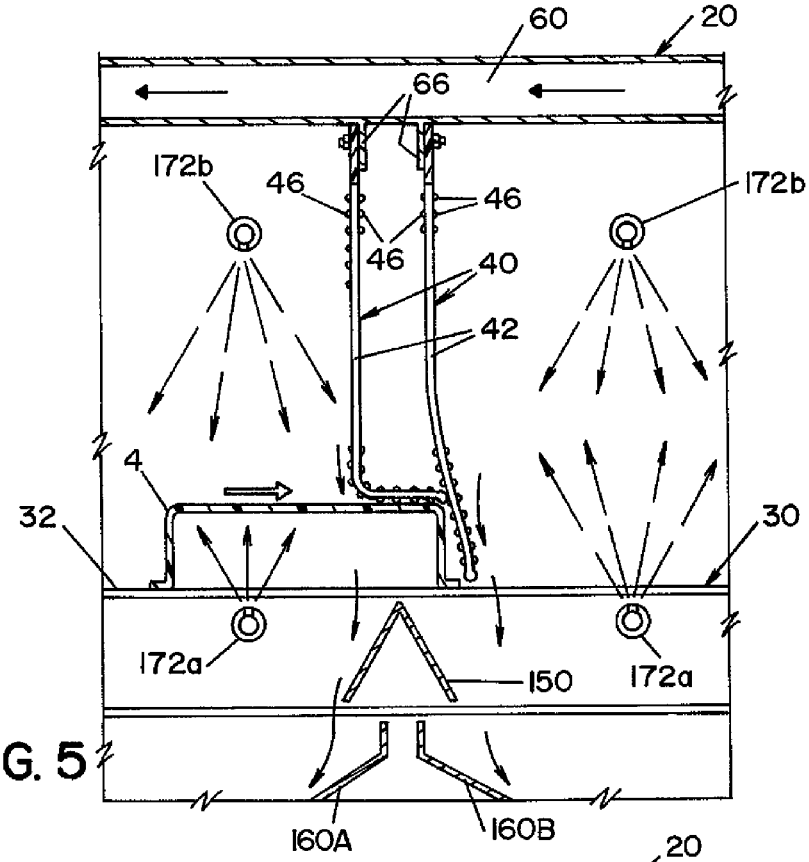
FIG. 5 is a sectional side view of a portion of the tunnel washer of FIG. 1, wherein portions of a washing chamber and a rinsing chamber are shown.
Figure 7:
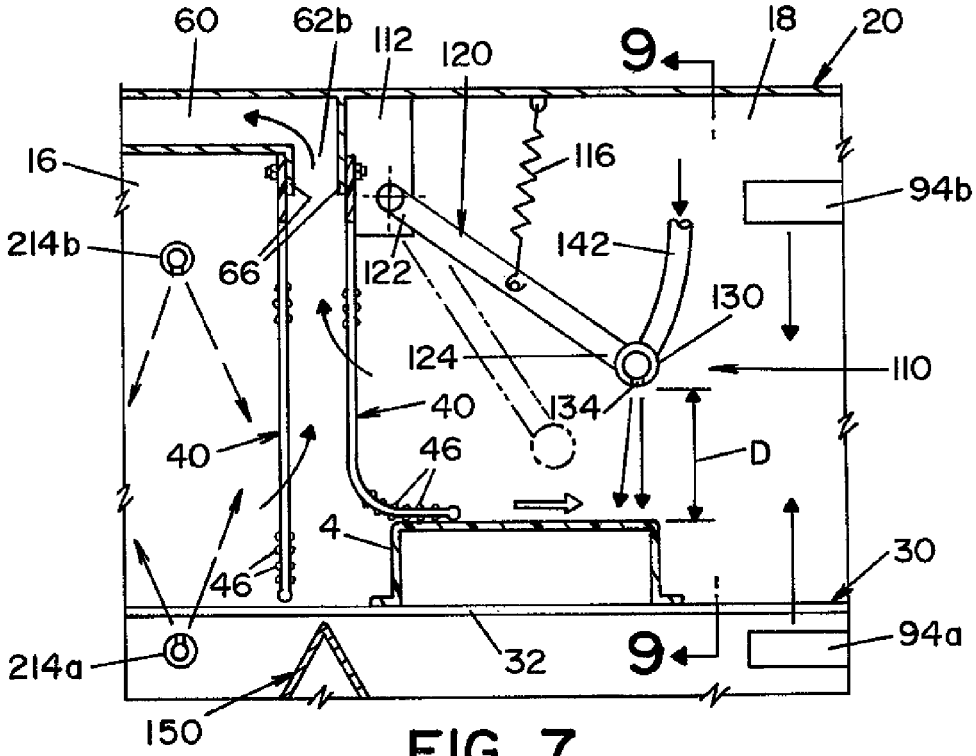
FIG. 7 is a sectional side view of a portion of the tunnel washer of FIG. 1, wherein a portion of a rinsing chamber and a drying chamber are shown, the drying chamber including an air manifold located in a first position.
Figure 8:
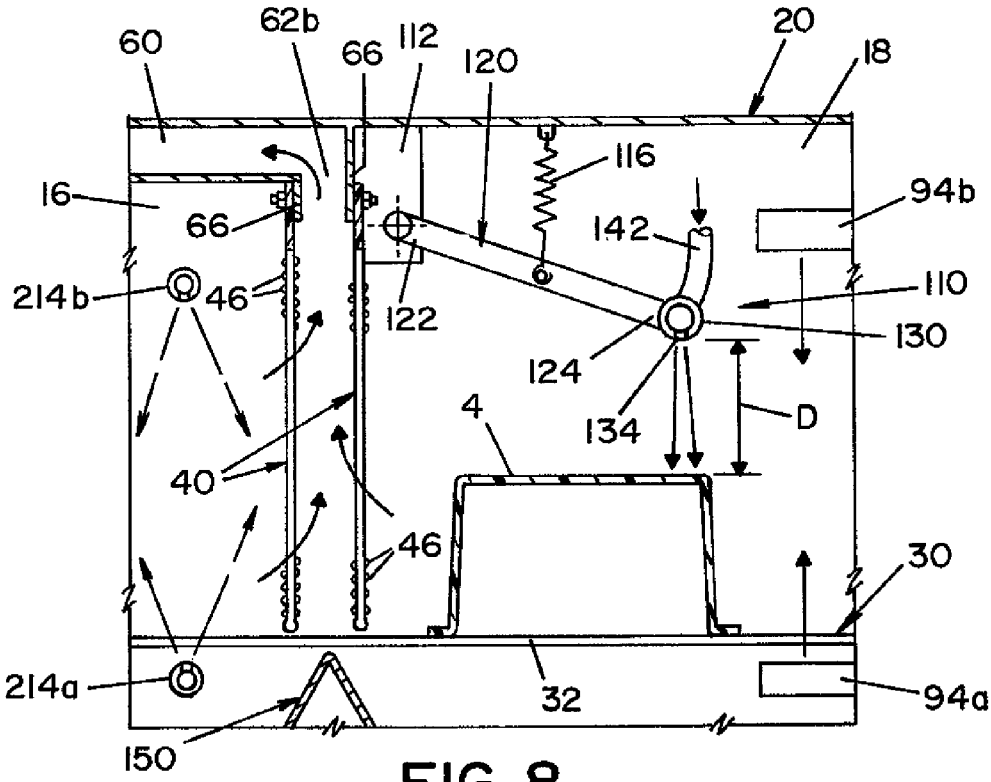
FIG. 8 is a sectional side view of a portion of the tunnel washer of FIG. 1, wherein a portion of a rinsing chamber and a drying chamber are shown, the drying chamber including an air manifold located in a second position.

Dividing curtains 40 are mounted in pairs, as best seen in FIGS. 5, 7, and 8. The pair of dividing curtains 40 are preferably spaced to provide a gap therebetween. A pair of spaced-apart dividing curtains 40 is located on opposite sides of inlet **62*a*, inlet 62*b* and inlet 92. Accordingly, these pairs of dividing curtains 40 respectively define a fluid pathway leading to inlets 62*a*, 62*b* of exhaust duct 60, and inlet 92 of exhaust duct 90**.

Figure 9:
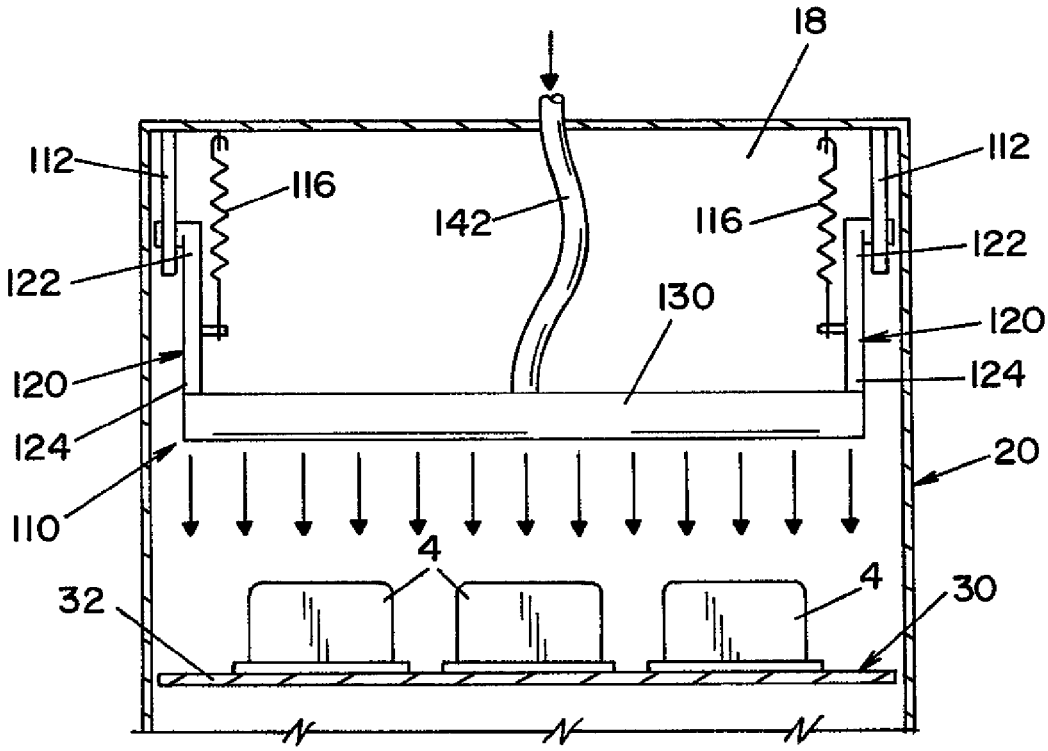
FIG. 9 is a cross-sectional view of the drying chamber, taken along lines 9-9 of FIG. 7.

A height-adjustable air manifold 110 provides high pressure streams of air for drying articles 4 in drying chamber 18, as best seen in FIGS. 7-9. Air manifold 110 is comprised of a pair of generally parallel arms 120, an air tube 130 and a pair of bias members 116. A first end 122 of each arm 120 is pivotally connected to a respective support member 112 located at the upper region of drying chamber 18. A second end 124 of each arm 120 supports air tube 130. A plurality of nozzles 134 are located along the length of air tube 130. Nozzles 134 provide streams of pressurized air. Air tube 130 is in fluid communication with a flexible air blower tube 142 that is connected with a blower 140 for supplying a source of air. Bias members 116 are connected between arms 120 and housing 20, as best seen in FIG. 9. Bias members 116 suspend air tube 130 above articles 4 traveling through drying chamber 18. In the illustrated embodiment, bias members 116 are springs. Bias members 116 allow air tube 30 to "float" above articles passing through drying chamber 18, as will be described in detail below.

Each chamber 12, 14, 16 and 18 has an associated fluid recovery and circulation system. Like components of each associated fluid recovery and circulation system are referred to by the same reference numbers.

With reference to pre-washing chamber 12, a sump 160A, located below conveyer belt 32, collects liquid from chamber 12. A heater 162 heats the liquid collected in sump 160A. A recirculation conduit 170 is in fluid communication with sump 160A to recirculate liquid collected by sump 160A back into pre-washing chamber 12. To this end, recirculation conduit 170 includes a lower outlet portion 172*a* and an upper outlet portion 172*b*. Lower outlet portion 172*a* is located in a lower region of chamber 12, while upper outlet portion 172*b* is located in an upper region of chamber 12. A plurality of nozzles are formed in lower outlet portion 172*a* and upper outlet portion 172*b*.

A pump 166 is provided in recirculation conduit 170 to pump liquid through recirculation conduit 170. A filter 176 is also provided in recirculation conduit 170 to filter recirculated liquid before it is returned to pre-washing chamber 12.

An exit conduit 178 fluidly connects recirculation conduit 170 with a shared drain conduit 190. Drain conduit 190 is in fluid communication with a drain. A secondary exit conduit 188 also connects recirculation conduit 170 with drain conduit 190. Secondary exit conduit 188 connects with recirculation conduit 170 at filter 176, as seen in FIG. 1.

An overflow conduit 194 fluidly connects sump 160A with drain conduit 190. Overflow conduit 194 prevents liquid from overflowing sump 160A. Valves V are located along exit conduit 178 and secondary exit conduit 188 to control fluid flow to drain conduit 190

Referring now to washing chamber 14, a sump 160B is located below conveyer belt 32 to collect liquid from chamber 14. A heater 162 heats the liquid collected in sump 160B.

A recirculation conduit 170 is in fluid communication with sump 160B to recirculate liquid collected by sump 160B back into washing chamber 14. To this end, recirculation conduit 170 includes a lower outlet portion 172*a* and an upper outlet portion 172*b*. Lower outlet portion 172*a* is located in a lower region of chamber 14, while upper outlet portion 172*b* is located in an upper region of chamber 14. A plurality of nozzles are formed in lower outlet portion 172*a* and upper outlet portion 172*b*. A pump 166 is provided in recirculation conduit 170 to pump liquid through recirculation conduit 170.

An exit conduit 178 fluidly connects recirculation conduit 170 with shared drain conduit 190.

Referring now to rinsing chamber 16, a sump 160C is located below conveyer belt 32 to collect liquid from chamber 16. A heater 162 heats the liquid collected in sump 160C.

A recirculation conduit 170 is in fluid communication with sump 160C to recirculate liquid collected by sump 160C back into rinsing chamber 16. To this end, recirculation conduit 170 includes a lower outlet portion 172*a* and an upper outlet portion 172*b*. Lower outlet portion 172*a* is located in a lower region of chamber 16, while upper outlet portion 172*b* is located in an upper region of chamber 16. A plurality of nozzles are formed in lower outlet portion 172*a* and upper outlet portion 172*b*. Recirculation conduit 170 also fluidly connects with a recycle conduit 180. Recycle conduit 180 includes a first recycle outlet 181 located in washing chamber 14 and a second recycle outlet 184 located in pre-washing chamber 12. First recycle outlet 181 includes a lower outlet portion 182*a* and an upper outlet portion 182*b*. Second recycle outlet 184 includes a lower outlet portion 186*a* and an upper outlet portion 186*b*. Nozzles are formed in lower outlet portion 182*a*, upper outlet portion 182*b*, lower outlet portion 186*a* and upper outlet portion 186*b*. A pump 166 is provided in recirculation conduit 170 to pump liquid through recirculation conduit 170.

An exit conduit 178 fluidly connects recirculation conduit 170 with shared drain conduit 190.

An overflow conduit 200 fluidly connects sump 160C and sump 160B with sump 160A. In this regard, overflow conduit 200 includes a first inlet 202*a* located in sump 160C, a second inlet 202*b* located in sump 160B, and an outlet 204 located at sump 160A.

A clean water conduit 210 connects rinsing chamber 16 with a source of clean water. Clean water conduit 210 includes a lower outlet portion 214*a* located in a lower region of rinsing chamber 16 and an upper outlet portion 214*b* located in an upper region of rinsing chamber 16. Nozzles are formed in lower outlet portion 214*a* and upper outlet portion 214*b*.

Referring now to drying chamber 18, a sump 160D is located below conveyer belt 32 to collect liquid from chamber 18. An exit conduit 198 fluidly connects sump 160D with shared drain conduit 190.

As best seen in FIG. 1, diverters 150 are located between adjacent chambers 12, 14, 16 and 18 to divert the flow of liquids away from the adjacent chamber. In the illustrated embodiment, a diverter 150 is generally centered under each pair of spaced dividing curtains 40, below conveyer belt 32.

Operation of tunnel washer 10 will now be described in detail. An article 4 (e.g., a cage) is placed onto conveyer belt 32, where it is sequentially conveyed through chambers 12, 14, 16 and 18, as is conventionally known. In pre-washing chamber 12, article 4 is typically exposed to hot water to remove dirt and debris. In washing chamber 14, article 4 is typically exposed to a detergent solution comprised of hot water and a suitable detergent. In rinsing chamber 16, residual detergent solution is removed from article 4 by spraying article 4 with hot water. In drying chamber 18, hot air is typically blown on article 4 to dry article 4, and remove any residual moisture therefrom.

As article 4 moves through dividing curtains 40 located at loading end 22, gaseous fluid (e.g., water vapor) escaping from pre-washing chamber 12 is captured in exhaust duct 60 at first inlet 62*a*, and exhausted to the ventilation system. Blower 68 draws gaseous fluid into exhaust duct 60. The spaced arrangement of dividing curtains 40 facilitates the flow of gaseous fluid into exhaust duct 60, and inhibits the escape of fluid external to tunnel washer 10 at loading end 22. Dividing curtains 40 provide a defined pathway for gaseous fluid to travel to exhaust duct 60, and provide a barrier for liquid fluids to inhibit their escape from tunnel washer 10 at loading end 22.

The spaced arrangement of dividing curtains 40 located between pre-washing chamber 12 and washing chamber 14 inhibits the transfer of fluids between chambers 12 and 14. Likewise, the spaced arrangement of dividing curtains 40 located between washing chamber 14 and rinsing chamber 16 inhibits the transfer of fluids between chambers 14 and 16.

As article 4 moves through dividing curtains 40 between rinsing chamber 16 and drying chamber 18, gaseous fluid (e.g., water vapor) escaping from rinsing chamber 16 is captured in exhaust duct 60 at second inlet 62*b*, and exhausted to the ventilation system. Blower 68 draws gaseous fluid into exhaust duct 60. The spaced arrangement of dividing curtains 40 facilitates the flow of gaseous fluid into exhaust duct 60, and inhibits the escape of fluid into drying chamber 18. Dividing curtains 40 provide a defined pathway for gaseous fluid to travel to exhaust duct 60, and provide a barrier to inhibit liquid fluids from escaping into drying chamber 18.

As article 4 moves through dividing curtains 40 located at unloading end 24, gaseous fluid escaping from drying chamber 18 is captured in recirculation duct 90 at inlet 92. Blower 104 draws gaseous fluid into recirculation duct 90. Inside recirculation duct 90, gaseous fluid is reheated by heater 106, and returned to drying chamber 18 through lower outlet portion 94*a* and upper outlet portion 94*b*. The spaced arrangement of dividing curtains 40 facilitates the flow of gaseous fluid into recirculation duct 90 by providing a defined pathway for gaseous fluid to travel to recirculation duct 90. The spaced arrangement of dividing curtains 40 also provides a fluid barrier that inhibits the escape of fluid from tunnel washer 10 at unloading end 24.

Figure 6:
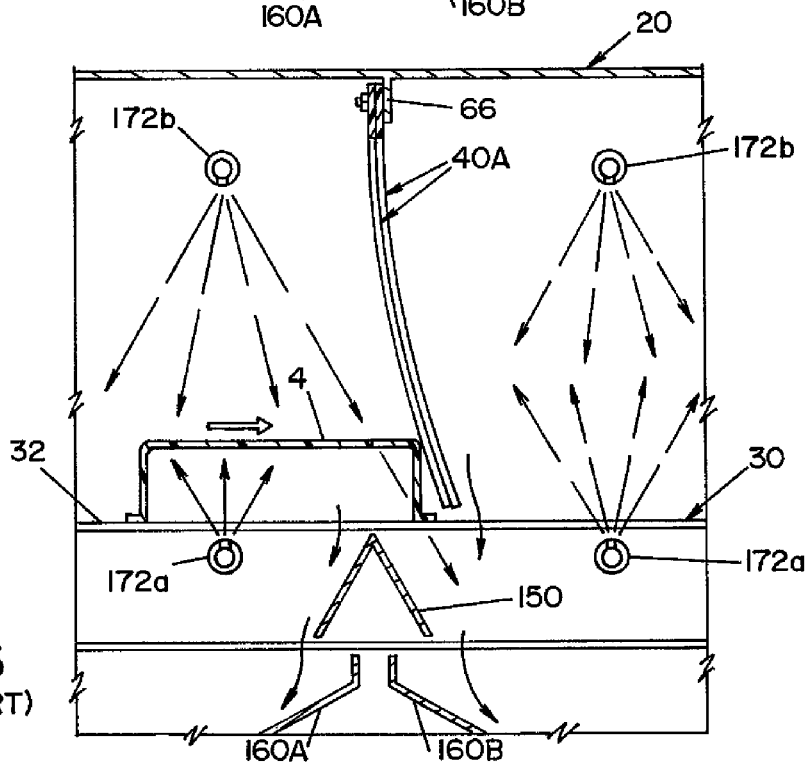
FIG. 6 (PRIOR ART)
FIG. 6 is a sectional side view of a portion of a prior art tunnel washer, wherein portions of a washing chamber and a rinsing chamber are shown.

In the prior art, a pair of dividing curtains 40A are mounted to a mounting member 66 (FIG. 6), but are not spaced apart, as dividing curtains 40 of the present invention (FIG. 5). Furthermore, dividing curtains 40A of the prior art do not include protuberances 46, as provided by the present invention. By spacing dividing curtains 40 and forming protuberances 46 on the surfaces thereof, dividing curtains 40 are less likely to stick together, as articles 4 are conveyed therethrough (as shown in FIG. 5), or stick to the articles 4 as they pass through dividing curtains 40. When dividing curtains stick together, an opening is created that allows the transfer of fluids between the chambers. The arrangement and design of dividing curtains 40 of the present invention isolate adjacent chambers. In this manner, dividing curtains 40 provide "mist control" to retain fluids within tunnel washer 10, and inhibit the transfer of fluids between adjacent chambers of tunnel washer 10. Even if one of the pair of dividing curtains 40 is moving due to the presence of an article 4, the second dividing curtain 40 acts as a barrier, as best seen in FIG. 5. Thus, dividing curtains 40 of the present invention isolate chambers 12, 14, 16 and 18, thereby minimizing fluid transfer between chambers and to the exterior of tunnel washer 10.

The number and location of exhaust inlets are optimized in tunnel washer 10 to minimize heat loss and fluid transfer. Inlet 62*a*, located at loading end 22, minimizes heat loss to the exterior of tunnel washer 10. Inlet 62*b*, located between rinsing chamber 16 and drying chamber 18, minimizes humidity transfer from rinsing chamber 16 to drying chamber 18. Consequently, drying efficacy is improved. Inlet 92 to recirculation duct 90, located at unloading end 24, also minimizes heat loss to the exterior of tunnel washer 10. Minimizing heat loss and fluid transfer contributes to a reduction in steam consumption required to maintain a desired temperature in tunnel washer 10.

Referring now to FIGS. 7-9, adjustable air manifold 110 is located inside drying chamber 18 to facilitate drying of articles 4. Air manifold 110 "floats" above articles 4 traveling through drying chamber 18. In this regard, bias members 116 suspend air tube 130 above articles 4 traveling through drying chamber 18. The distance between air tube 130 relative to the upper surface of article 4 is substantially maintained at distance D, regardless of the dimensions (i.e., height) of article 4 traveling therethrough. In this regard, as streams of pressurized air are emitted from nozzles 134 and sprayed against article 4 to dry article 4, the force of the air pressure applied to article 4 pushes air tube 130 away from article 4 to generally maintain a distance D between air tube 130 and the upper surface of article 4. As best seen in FIGS. 7 and 8, distance D is generally maintained regardless of the height of article 4. Accordingly, drying efficiency is substantially the same regardless of the height of article 4. In a preferred embodiment, the streams of pressurized air emitted from nozzle 134 are directed generally perpendicular to the surface of conveyer belt 32.

It should be appreciated that air manifold 110 may also act as an additional barrier for preventing fluids from entering drying chamber 18 from rinsing chamber 16. This also contributes to drying efficacy.

Referring now to FIG. 1, fluid recovery and circulation operations of chambers 12, 14, 16, and 18 will be described. Water sprayed into rinsing chamber 16 from clean water conduit 210 is recirculated inside rinsing chamber 16 and recycled to both washing chamber 14 and pre-washing chamber 12 via recycle conduit 180. The liquid used in chambers 12, 14 and 16 will be progressively cleaner, since more soil will be removed from article 4 after each sequential processing step in chambers 12, 14 and 16. Water sprayed into rinsing chamber 16 is collected in sump 160C and recirculated back into rinsing chamber 16 through recirculation conduit 170. Water collected in sump 160C is also recycled to chambers 14 and 16 through recycle conduit 180. Water sprayed into washing chamber 14 is collected in sump 160B and recirculated back into chamber 14 through recirculation conduit 170. Furthermore, water sprayed into pre-washing chamber 12 is collected in sump 160A and recirculated back into chamber 12 through recirculation conduit 170. Since articles 4 will be the most soiled when passing through pre-washing chamber 12, the recycled water in chamber 12 passes through filter 176 before being recirculated back into chamber 12.

Overflow liquid in sumps 160B and 160C flow into sump 160A via overflow conduit 200. In the illustrated embodiment, each sump 160A, 160B and 160C has a progressively larger volume capacity. Furthermore, the height of inlets 196*a*, 202*a*, 202*b* are progressively higher within respective sumps 160A, 160B and 160C. Residual liquid collected by sump 160D in drying chamber 18 is directed to drain conduit 190 via exit conduit 198.

Other modifications and alterations will occur to others upon their reading and understanding of the specification. It is intended that all such modifications and alterations be included insofar as they come within the scope of the invention as claimed or the equivalents thereof.

Having described the invention, the following is claimed:

1. A tunnel washer for washing an article, comprising:

a pre-washing chamber, a washing chamber, and a rinsing chamber;

an exhaust duct in fluid communication with a ventilation system, said exhaust duct having a first inlet;

a first dividing curtain disposed at an entrance to said pre-washing chamber of said tunnel washer;

a second dividing curtain disposed at said entrance to said pre-washing chamber and spaced from said first dividing curtain in a horizontal conveying direction through said tunnel washer, said first and second dividing curtains disposed generally parallel to each other to define a gaseous fluid pathway therebetween, wherein said gaseous fluid pathway communicates with said first inlet of said exhaust duct and wherein said first and second dividing curtains provide a physical barrier to liquids between the gaseous fluid pathway and all liquid fluid dispensing devices; and a blower for drawing fluid into the exhaust duct from the gaseous fluid pathway and for exhausting through the ventilation system; a drying chamber; and a recirculation duct in fluid communication with both the drying chamber and second gaseous fluid pathway for circulating fluid between said gaseous fluid pathway and said drying chamber.

2. A tunnel washer according to claim 1, further comprising:

a second inlet of the exhaust duct;

a third dividing curtain disposed at an entrance to said drying chamber of said tunnel washer; and a fourth dividing curtain disposed at said entrance to said drying chamber of said tunnel washer and spaced from said third dividing curtain in said horizontal conveying direction through said tunnel washer, said third and fourth dividing curtains disposed generally parallel to each other to define a second gaseous fluid pathway therebetween, wherein said second gaseous fluid pathway communicates with said second inlet of said exhaust duct and wherein said third and fourth dividing curtains provide a physical barrier to liquids between the second gaseous fluid pathway and all liquid dispensing devices.

3. A tunnel washer for washing an article, comprising:

a pre-washing chamber, a washing chamber, and a rinsing chamber;

an exhaust duct in fluid communication with a ventilation system, said exhaust duct having a first inlet;

a first dividing curtain disposed at an entrance to said pre-washing chamber of said tunnel washer;

a second dividing curtain disposed at said entrance to said pre-washing chamber and spaced from said first dividing curtain in a horizontal conveying direction through said tunnel washer, said first and second dividing curtains disposed generally parallel to each other to define a gaseous fluid pathway therebetween, wherein said gaseous fluid pathway communicates with said first inlet of said exhaust duct and wherein said first and second dividing curtains provide a physical barrier to liquids between the gaseous fluid pathway and all liquid fluid dispensing devices;

a blower for drawing fluid into the exhaust duct from the gaseous fluid pathway and for exhausting through the ventilation system a drying chamber;

a recirculation duct in fluid communication with both the drying chamber and a second gaseous fluid pathway for circulating fluid between said second gaseous fluid pathway and said drying chamber;

a blower located along said recirculation duct for withdrawing gaseous fluid from the second gaseous fluid pathway and conveying the gaseous fluid to the drying chamber; and a heater located along said recirculation duct to heat the gaseous fluid withdrawn from the second gaseous fluid pathway before the gaseous fluid is conveyed to the drying chamber.

4. A tunnel washer for washing an article, comprising:

a pre-washing chamber, a washing chamber, and a rinsing chamber;

an exhaust duct in fluid communication with a ventilation system, said exhaust duct having a first inlet and a second inlet for receiving fluid;

a blower for drawing fluid into the exhaust and for exhausting through the ventilation system;

a first dividing curtain disposed at an entrance to said pre-washing chamber of said tunnel washer; and a second dividing curtain disposed at said entrance to said pre-washing chamber and spaced from said first dividing curtain in a horizontal conveying direction through said tunnel washer, said first and second dividing curtains disposed generally parallel to each other to define a gaseous fluid pathway therebetween, wherein said gaseous fluid pathway communicates with said first inlet of said exhaust duct and wherein said first and second dividing curtains provide a physical barrier to liquids between the gaseous fluid pathway and all liquid dispensing devices; a drying chamber; and a recirculation duct in fluid communication with both the drying chamber and second gaseous fluid pathway for circulating fluid between said gaseous fluid pathway and said drying chamber.

5. A tunnel washer according to claim 4, further comprising:

a third dividing curtain disposed at an entrance to said drying chamber of said tunnel washer; and a fourth dividing curtain disposed at said entrance to said drying chamber of said tunnel washer and spaced from said third dividing curtain in said horizontal conveying direction through said tunnel washer, said third and fourth dividing curtains disposed generally parallel to each other to define a second gaseous fluid pathway therebetween, wherein said second gaseous fluid pathway communicates with said second inlet of said exhaust duct and said third and fourth dividing curtains provide a physical barrier to liquids between the second gaseous fluid pathway and all liquid dispensing devices.

6. A tunnel washer for washing an article, comprising:

a pre-washing chamber, a washing chamber, and a rinsing chamber;

an exhaust duct in fluid communication with a ventilation system, said exhaust duct having a first inlet and a second inlet for receiving fluid;

a blower for drawing fluid into the exhaust and for exhausting through the ventilation system;

a first dividing curtain disposed at an entrance to said pre-washing chamber of said tunnel washer;

a second dividing curtain disposed at said entrance to said pre-washing chamber and spaced from said first dividing curtain in a horizontal conveying direction through said tunnel washer, said first and second dividing curtains disposed generally parallel to each other to define a gaseous fluid pathway therebetween, wherein said gaseous fluid pathway communicates with said first inlet of said exhaust duct and wherein said first and second dividing curtains provide a physical barrier to liquids between the gaseous fluid pathway and all liquid dispensing devices;

a drying chamber;

a recirculation duct in fluid communication with both the drying chamber and a second gaseous pathway for circulating fluid between said second gaseous fluid pathway and said drying chamber;

a blower located along said recirculation duct for withdrawing gaseous fluid from the second gaseous fluid pathway and conveying the gaseous fluid to the drying chamber; and a heater located along said recirculation duct to heat the gaseous fluid withdrawn from the second gaseous fluid pathway before the gaseous fluid is conveyed to the drying chamber.

* * * * *